US009560918B2

(12) United States Patent
Edwards

(10) Patent No.: US 9,560,918 B2
(45) Date of Patent: Feb. 7, 2017

(54) FURNITURE STRUCTURE PROVIDING WEAPON DELIVERY SYSTEM

(71) Applicant: Franklin Henry Edwards, Shelbyville, MI (US)

(72) Inventor: Franklin Henry Edwards, Shelbyville, MI (US)

( * ) Notice: Subject to any disclaimer, the term of this patent is extended or adjusted under 35 U.S.C. 154(b) by 382 days.

(21) Appl. No.: 14/218,195

(22) Filed: Mar. 18, 2014

(65) Prior Publication Data

US 2016/0166072 A1 Jun. 16, 2016

Related U.S. Application Data

(60) Provisional application No. 61/853,754, filed on Apr. 11, 2013.

(51) Int. Cl.

| | |
|---|---|
| ***A47C 19/22*** | (2006.01) |
| ***A47C 19/02*** | (2006.01) |
| ***A47B 81/00*** | (2006.01) |

(52) U.S. Cl.

CPC ..... *A47C 19/22* (2013.01); *A47B 81/005* (2013.01); *A47C 19/022* (2013.01)

(58) Field of Classification Search

CPC ..... A47C 19/22
USPC ..... 5/280, 308, 503.1, 931
See application file for complete search history.

(56) References Cited

U.S. PATENT DOCUMENTS

| | | | | |
|---|---|---|---|---|
| 795,155 | A | 7/1905 | Nees | |
| 2,933,737 | A | 4/1960 | Schiffmann | |
| 4,869,449 | A | 9/1989 | Goodman | |
| 5,056,342 | A | 10/1991 | Prinz | |
| 5,095,566 | A | 3/1992 | Russell | |
| 5,111,545 | A | 5/1992 | Krozal | |
| 5,317,888 | A | 6/1994 | Towns | |
| 5,713,650 | A | 2/1998 | King et al. | |
| 5,732,914 | A | 3/1998 | Flinn | |
| 5,916,087 | A | 6/1999 | Owens | |
| 6,292,960 | B1 | 9/2001 | Bowling | |
| 6,405,861 | B1 * | 6/2002 | Siler | F41C 33/06 206/1.5 |
| 6,523,374 | B1 | 2/2003 | Owens | |
| 6,684,432 | B2 | 2/2004 | Owens, Jr. | |
| 7,181,784 | B1 | 2/2007 | Geilear | |
| 8,074,477 | B1 | 12/2011 | Weiche | |
| 8,201,426 | B2 | 6/2012 | Heim et al. | |
| 8,327,777 | B2 | 12/2012 | Heim et al. | |
| 8,479,331 | B2 | 7/2013 | Craighead | |
| 8,506,023 | B2 | 8/2013 | Goldie | |

(Continued)

*Primary Examiner* — Fredrick Conley
(74) *Attorney, Agent, or Firm* — Price Heneveld LLP

(57) ABSTRACT

A weapon delivery system includes a vertical structure defining an opening and a hidden compartment above the opening, and a delivery structure pivoted to a bottom of the vertical structure that when in a closed position generally covers the opening. The delivery structure includes a horizontal top member adapted to support a long gun in a known orientation in the hidden compartment and, when the delivery structure is moved to an open position, causes the long gun to be dropped onto the hands of the person in the known orientation. This allows the person to immediately grasp the long gun in a manner ready to deal with an intruder or danger. The illustrated system is a bed headboard positioned so that a person sleeping on the bed can reach up, press the delivery structure, and drop the long gun into their waiting hands.

20 Claims, 3 Drawing Sheets

(56) References Cited

U.S. PATENT DOCUMENTS

| | | | | |
|---|---|---|---|---|
| 8,533,876 | B2 | 9/2013 | Bonk | |
| 8,534,206 | B2 | 9/2013 | Heim et al. | |
| 2008/0236452 | A1* | 10/2008 | Pratt | A47B 85/00 108/13 |
| 2010/0212372 | A1* | 8/2010 | Wolfe | A47B 81/00 70/78 |

* cited by examiner

FURNITURE STRUCTURE PROVIDING WEAPON DELIVERY SYSTEM

This application claims benefit under 35 USC section 119(e) of provisional application Ser. No. 61/853,754, filed Apr. 11, 2013, entitled: BED HEADBOARD FIREARM CONCEALMENT, the entire contents of which are incorporated herein in their entirety.

BACKGROUND

The present invention relates structures that provide a weapon delivery system for delivering long guns (e.g. rifles, shot guns) from a hidden compartment, and in particularly relates to a vertical structure (e.g. furniture or headboard) able to deliver a stored long gun quickly to an owner in a known orientation via a simple panel movement. The illustrated structure is a bed headboard with storage compartment therein, but it is contemplated that the present innovation is not limited to only headboards or furniture. Instead, the present innovation can be incorporated into any vertical structure where a person is immediately adjacent the vertical panel in a known position relative to a weapon stored therein, particularly where the person's hands are ready to receive and hold the weapon in a ready-for-use position.

Many gun owners want to store their guns in a safe but easily accessible place, for example so that their rifle is quickly available for home defense and personal safety. One example is where a person may want to access their weapon in the middle of the night to defend themselves against an intruder in their house. However, in addition to nights being dark, and also to the awoken person being startled and unsettled, it is very difficult to traverse quietly to the location of a stored rifle, load it, grip the gun in a safe manner, and otherwise get ready to confront the intruder without making unwanted noise. In some circumstances, it may be preferable not to turn on lights, and even if a light can be turned on, it would take a while for an awoken person's eyes to become accustom to the light.

A weapon delivery system is desired that is able to safely store a long gun in a concealed location while also being capable of quickly delivering the rifle into awaiting hands of the gun owner in a way that naturally and inherently causes the gun owner to grip and hold the gun safely in a natural orientation in their hands for immediate use, potentially without even getting out of bed.

SUMMARY OF THE PRESENT INVENTION

In one aspect of the present invention, a weapon delivery system for delivering a hidden long gun quickly to a user comprises a vertical structure defining a hidden compartment shaped to store the long gun, and an opening below and adjacent the hidden compartment, and a delivery structure covering the opening when in a closed position. The delivery structure includes a top member for supporting the long gun in a known orientation in the hidden compartment, but further, when moved toward an open position, is configured to drop the long gun onto awaiting hands of the user in the known orientation. In a narrower form, the hidden compartment is lockable.

In a narrower aspect, the present invention includes providing a bed comprising a mattress and a headboard, the headboard including the vertical structure and the delivery structure defined above. The delivery structure is located at a height so that a person sleeping on the mattress can reach toward and press against the delivery structure to cause the delivery structure to move to the open position and drop the long gun. Thus, with a single hand movement, the long gun is dropped onto the person's hands in the known orientation by gravity.

In another aspect of the present invention, a storage system provides hidden storage of an article but quick access the article. The storage system comprises a vertical structure defining a hidden compartment shaped to store an elongated article and an opening below and adjacent the hidden compartment, and a delivery structure movably supported by the vertical structure and covering the opening when in a closed position. The delivery structure includes a top member for supporting the article in a known orientation in the hidden compartment, but further, when moved toward an open position, being configured to drop the article onto awaiting hands of the user.

In another aspect of the present invention, a method for delivering a long gun quickly to a user comprises providing a vertical structure defining a hidden compartment shaped to store the long gun, and an opening below and adjacent the hidden compartment, and providing a delivery structure covering the opening when in a closed position and the delivery structure including a top member. The method further includes supporting the long gun in a known orientation in the storage location on the top member, and dropping the long gun onto awaiting hands of a user in a known orientation when the top member is moved.

An object of the present invention is to provide quick access to a long gun, placing the long gun in a ready-to-use position in the user's hands with only a single hand movement.

An object of the present invention is to provide a safe and secure storage location that is very secure, but that does not detract from a room's appearance and aesthetics.

An object of the present invention is to provide a storage location that is difficult for an intruder or other unauthorized person to find unless they are familiar with the storage location and how to access it.

An object of the present invention is to provide a hidden compartment for a long gun where the long gun is protected from dust, where gun oil and cleaners are not likely to get on furniture and household articles located in and around the hidden compartment, and where the hidden compartment is not likely to be noticed by an intruder or other unauthorized person located inside a house or even outside a window of a house.

An object of the present invention is to provide a hidden compartment for a long gun where the long gun is immediately and quickly available to a person sleeping on a bed.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 2:
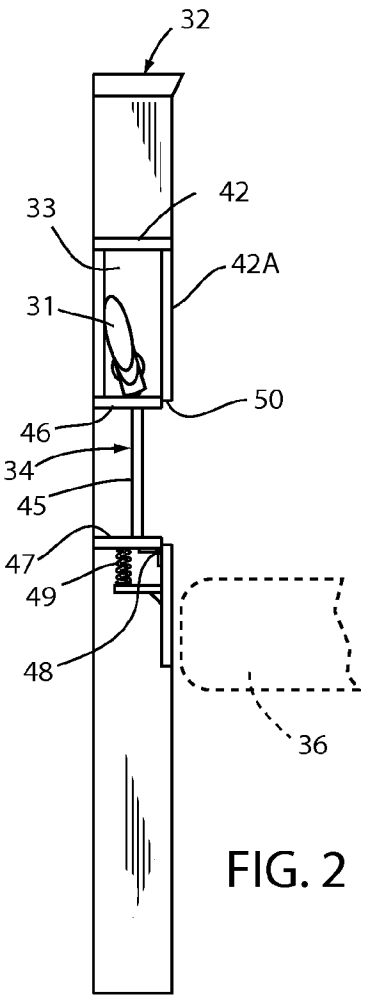
FIGS. 1-2 are front (i.e. "mattress-side") and cross-sectional views of a bed headboard, the headboard having a top shelf, FIG. 2 showing the bed's mattress extending generally horizontally to the right and further showing a long gun in a hidden compartment in the headboard supported on a T-shaped delivery structure.
Figure 1:
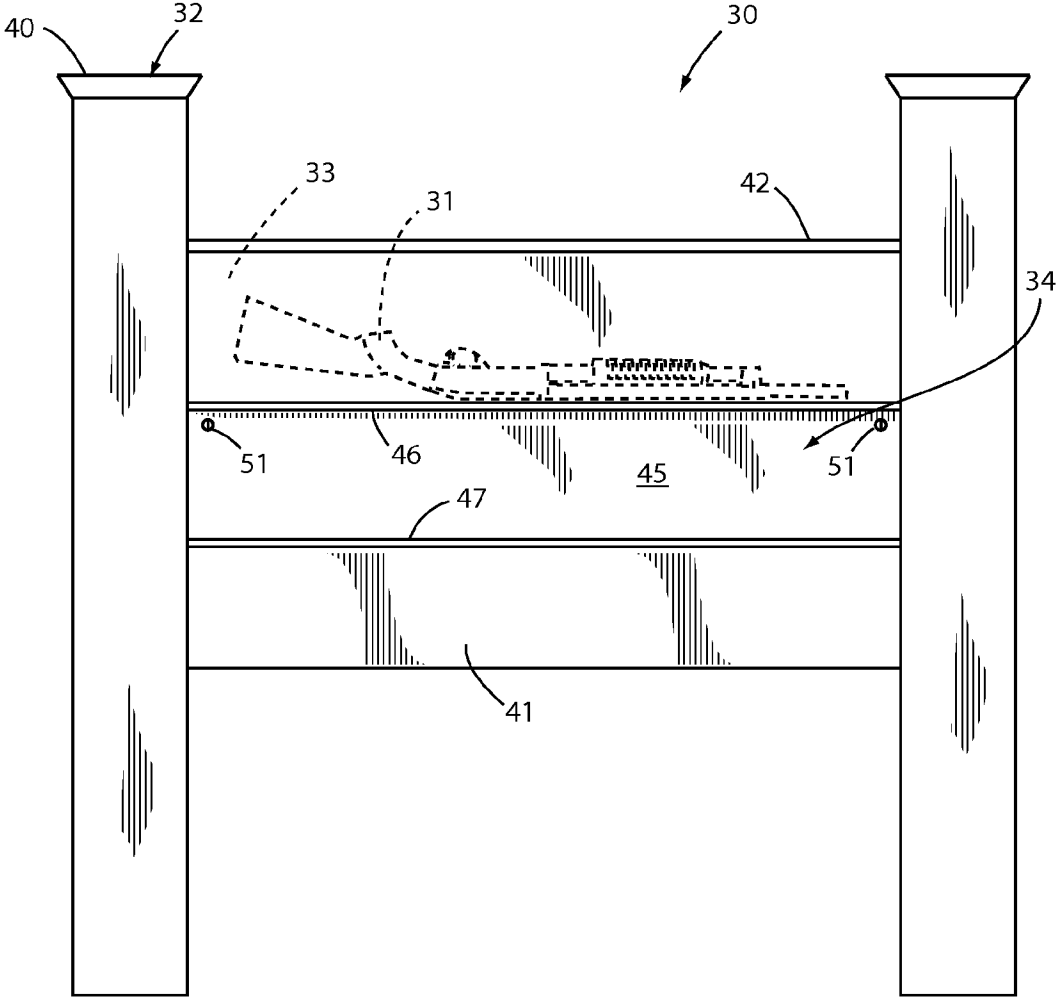

The present apparatus 30 (FIGS. 1-2) forms a weapon delivery system adapted to support a long gun 31 (such as a rifle) in a known orientation in a vertical structure 32 (illustrated as a bed headboard) having a hidden compartment 33. When activated, a delivery structure 34 in the vertical structure 32 causes the long gun 31 to drop onto the hands 35 of a person in the known orientation. Advantageously, when the person's hands 35 are used to operate the system (i.e. pivotally move the delivery structure 34), the hands 35 are in a natural position ready to catch the long gun 31 as it drops by gravity. This allows the person to immediately grasp the long gun and be ready to deal with an intruder or danger.

The illustrated vertical structure 32 is a bed headboard with a mattress 36 located to support a resting person slightly below a bottom of the delivery structure 34, such that the person's hands are naturally positioned near the delivery structure 34. The illustrated vertical structure 32 includes posts 40 (also called "legs" when used for the bed) for attachment to side rails of a mattress-supporting frame, and additional transverse boards forming an aesthetic portion of the headboard. For example, the additional transverse boards include a lower board 41 (sometimes called a "pillow board") for abutting the mattress 36 and pillow, and top head boards 42 and 42A forming a top shelf between the posts 40, and forming the hidden compartment 33. The boards 41, 42, and 42A form an opening therebetween in which the delivery structure 34 fits.

The delivery structure 34 includes a vertical tip board 45, and horizontal top and bottom members 46-47 fixed to the tip board 45. The top member 46 is the carrier of the long gun 31, and is shaped to support the long gun 31 in a known position and orientation when in the hidden compartment 33, yet is sufficiently lubricious so that the long gun 31 will slide off the top member 46 when the gun abuts against the top head board 42A as the delivery structure 34 is pivoted rearwardly toward its open position. As illustrated, a thinness of the hidden compartment 33 helps hold the long gun 33 in its known (desired) orientation. The tip board 45 is pivoted to the lower board 41 by a pivot 48 (such as a piano hinge or 2-4 individual hinges). Notably, the illustrated delivery structure 34 is pivoted by the pivot 48, but it is contemplated that it can pivot on a different pivot-permitting structure or slide on a track or drawer glide or be movably supported in another manner. A pair of bias springs 49 spaced behind the pivot 48 are configured and attached to bias the bottom member 47 (and hence bias the entire delivery structure 34) toward the closed position. In the closed position, the tip board 45 and members 46-47 close the opening, such that the vertical structure 32 looks like a typical bed headboard.

Additional features can be added to the present apparatus 30. For example, a latch 50 can be attached to the vertical structure 32 near a top of the delivery structure 32 (such as a latch 50 that engages the tip board 45 or top member 47) to help hold the delivery structure 34 in a fully aligned closed position. Locks 51 can also be included, such as one lock at each end of the tip board 45 where either one of the two people resting on a bed can operate a. lock to prevent a third person from accessing the long gun 31 (and/or prevent the other person on the bed from accessing the long gun 31 until the first person is awake and agrees). Lights, mirrors, and other shelves and small compartments can also be formed in and around the vertical structure 32. For example, the small compartments can be lockable, and be adapted to receive ammunition and gun supplies, or can be made to receive jewelry and valuables. In particular, it is contemplated that the vertical structure 32 and delivery structure 34 can be adapted to be a safe-like structure, with appropriate locks and security for holding valuables other than a long gun.

Figure 3:
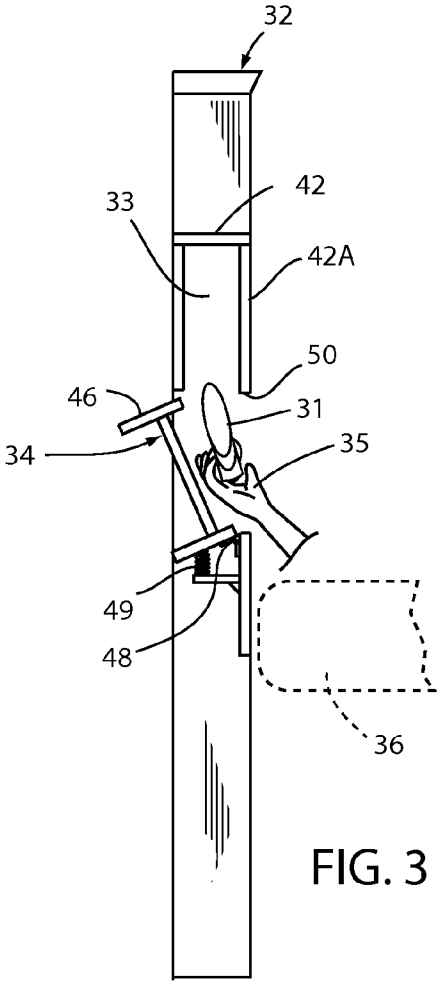
FIG. 3 is a view similar to FIG. 2, but showing the delivery structure pivoted so that the gun drops from the hidden compartment onto awaiting hands of a user in the known orientation.
Figure 7:
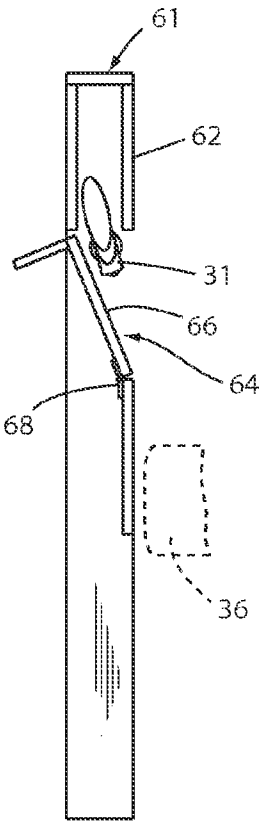
FIGS. 6-7 are side views of FIG. 5, FIG. 6 showing the delivery structure in a closed position and FIG. 7 showing it in an open position.
Figure 6:
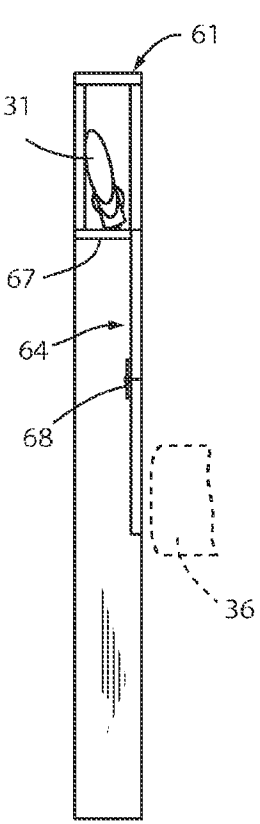

FIG. 3 shows the tip board 45 (i.e. delivery structure 34) pushed back into the vertical structure 32, which is easily done when resting on the bed since the person's hands are immediately adjacent the tip board 45. This allows the person to quickly access whatever valuable or useful article is in the hidden compartment 33 that the person wanted to conceal. For example, the illustrated article is a long gun 31, which advantageously is held in a predetermined orientation so that when the tip board 45 (i.e. delivery structure 34) is pressed, the long gun 31 is dropped into the waiting hands. This can occur extremely quickly. For example, with a little practice, the tip board 45 can be moved and long gun 33 grasped for use within about 2 seconds.

Figure 4:
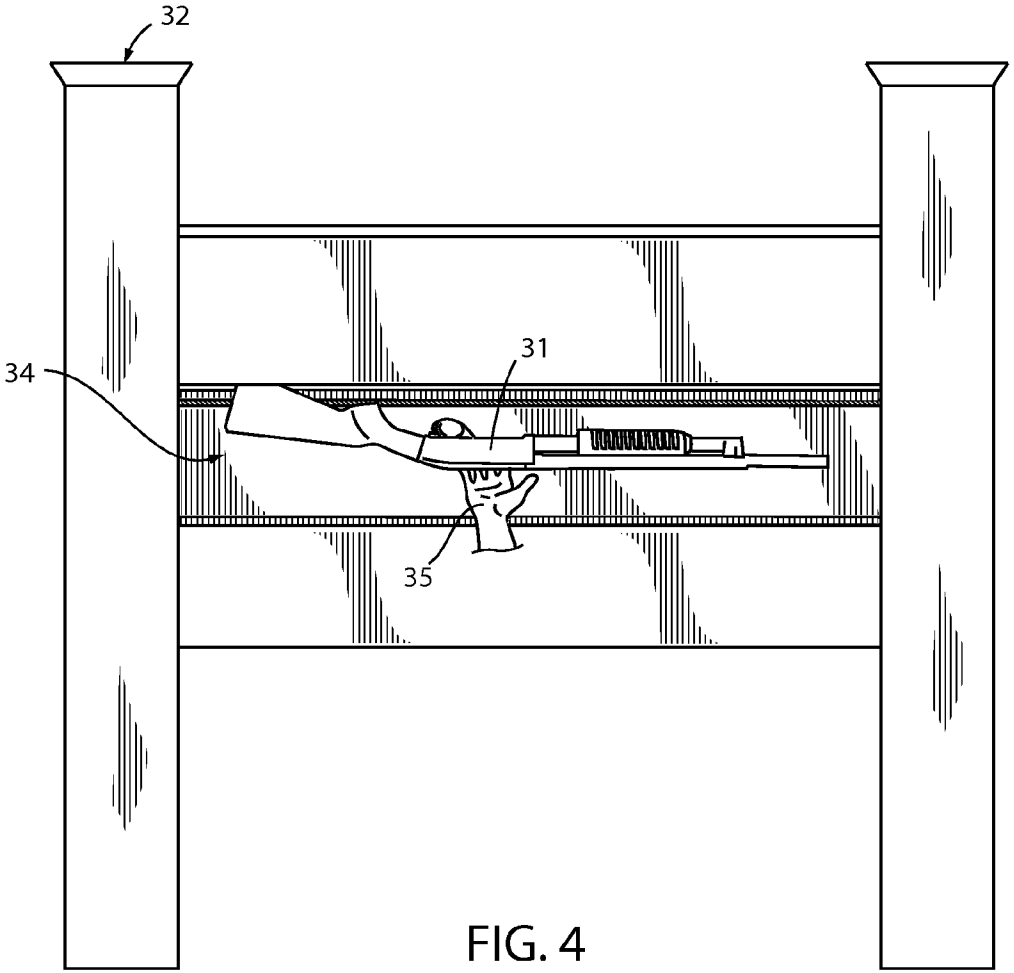
FIG. 4 is a view similar to FIG. 1, but showing the long gun partially dropped from the storage cavity, with the long gun being in the known orientation so that when caught, the gun is positioned in the user's hands for quick use.

In normal operation, one would use the bed in a normal manner with this headboard (vertical structure 32) installed on a bed. The mattress 36 would be in front of the headboard, and pillows would be against the pillow board (42). If there was a home invasion, the person in this bed could decide if it would be best to use a firearm to protect themselves and their family. All they would have to do to access their firearm is reach their hands above their head while lying in the bed, and with open hands using their fingertips, push the tip board 45 back. The orientation to the person in the bed would be to push up, above their head. The bottom of the tip board 45 is attached to the hinge 48 and will pivot against the (light) force of springs 49. The top member 46 of the delivery structure 24 will move about three (3) inches. By doing so, the bottom of the hidden compartment 33 opens, allowing the long gun 33 to fall freely into the already open hands of the person in bed. FIG. 4 shows where and how the long gun 33 drops. With very little practice, the average man or woman can accomplish the whole movement in about two (2) seconds, maybe less if in a hurry. They can move from lying in bed under the covers to holding the firearm 33 and pointing it at an intruder or lethal threat in about two seconds. That is less time than it would take to roll over in bed to reach for a firearm leaning against the bed or against a wall next to the bed.

Figure 5:
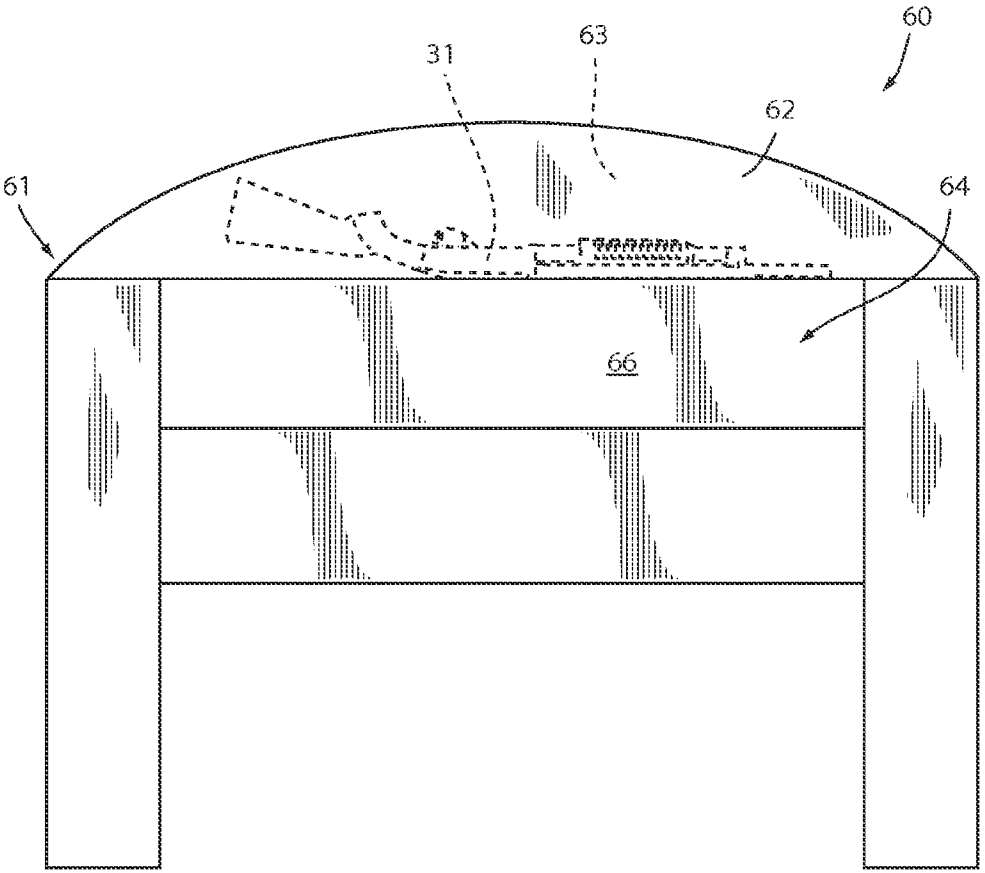
FIG. 5 is a front view of a modified vertical structure similar to FIG. 1, but showing a modified upper portion forming the hidden compartment for the long gun.

It is contemplated that the vertical structure 32 can be modified to a variety of different arrangements and configurations. For example, see the bed apparatus 60 in FIG. 5 which includes components that operate similar to apparatus 30, but includes a vertical structure 61 with modified arch-forming upper boards 62 extend between the posts 40 and form the hidden compartment 63 within the arch shape. Also, the delivery structure 64 is pivoted to the bottom board 65, and includes a vertical tip board 66 and a horizontal gun-carrier top board 67. The top board 67 forms a T-shape or inverted L-shape with the tip board 66, and is biased by springs (not specifically shown) at the hinge 68. Alternatively, springs can be used on sides or near a top of the tip board 66 (such as extending between the tip board 66 and the top board 67).

It is noted that the present apparatus 30 is illustrated as a bed headboard, but it is contemplated that the present innovation can be applied to a wide variety of structures other than beds, including, shelves, furniture, wall room dividers, cabinets, and other vertical structures such as full-height wall dividers, display cases, and even building walls. Also, the vertical structure 32 is illustrated as a plurality of vertical and horizontal panels forming an opening with a hidden compartment above the opening, and with the delivery structure 34 being an upright panel pivoted at its bottom to the vertical structure 32. However, it is contemplated that the present innovations can be applied to a wide variety of structures other than ones made of orthogonally related panel components. Specifically, it is contemplated that the present innovation can be integrated into any vertical structure having a depth and height sufficient to form a hidden compartment for a long gun, especially where a person is likely to be located adjacent the structure with their hands slightly below and/or under the hidden compartment.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A weapon delivery system for delivering a hidden on gun quickly to a user, comprising:

a vertical structure defining a hidden compartment shaped to store the long gun, and an opening below and adjacent the hidden compartment; and a delivery structure covering the opening when in a closed position, the delivery structure including a top member for supporting the long gun in a known orientation in the hidden compartment, but further, when moved toward an open position, being configured to drop the long gun onto awaiting hands of the user in the known orientation;

wherein the delivery structure includes a vertical panel that at least in part defines the opening;

wherein the vertical structure comprises furniture;

wherein the furniture is a headboard of a bed;

wherein the opening includes a side-facing opening portion, and wherein the delivery structure includes a vertical panel approximately a size of the side-facing opening portion, the top member including a horizontal panel attached atop the vertical panel that both closes a top of the opening and also that includes a generally horizontal top surface that supports the long gun in the known orientation.

2. The system defined in claim 1, wherein the horizontal panel includes a top surface adapted to slidably support the long gun, and the vertical structure includes a gun-abutting structure that moves across the top surface to cause the long gun to slide off the top surface when the delivery structure is moved from the closed position to the open position.

3. A weapon delivery system for delivering a hidden long gun quickly to a user, comprising:

a vertical structure defining a hidden compartment shaped to store the long gun, and an opening below and adjacent the hidden compartment; and a delivery structure including a top member with a top surface covering the opening when in a closed position, the top surface being configured for supporting the long gun in a known orientation in the hidden compartment, but further, when the top member is moved toward an open position, being sufficiently lubricious for the long gun to slide off the top member and drop the long gun onto awaiting hands of the user in the known orientation.

4. The system defined in claim 3, wherein the delivery structure includes a vertical panel that at least in part defines the opening.

5. The system defined in claim 4, wherein the vertical structure comprises furniture.

6. The system defined in claim 5, wherein the furniture is a headboard of a bed.

7. The system defined in claim 3, wherein the delivery structure includes a vertical panel approximately a size of the opening that is pivoted to the vertical structure, and further the top member includes a horizontal panel attached atop the vertical panel, so that when the person uses their hands to pressingly move the delivery structure from the closed position to the open position, the long gun drops directly onto the hands of the person in a close-to-ready use position.

8. The system defined in claim 3, including a biasing device on the delivery structure that biases the delivery structure toward the closed position.

9. The system defined in claim 8, wherein the biasing device includes at least one mechanical spring biasing the delivery structure toward the closed position.

10. The system defined in claim 3, including a securement member comprising one of a latch or lock for securing the delivery structure in the closed position until the securement member is moved to a release position.

11. The system defined in claim 10, wherein the securement member includes at least one lock.

12. The system defined in claim 3, wherein the vertical structure includes front and rear walls defining a width dimension of the compartment, and the top member has a dimension approximately equal to the width dimension.

13. A bed comprising a mattress and a headboard, the headboard including the vertical structure and the delivery structure defined in claim 3, with the delivery structure being located at a height so that a person sleeping on the mattress can reach toward and press against the delivery structure to cause the delivery structure to move to the open position and drop the long gun, such that with a single hand movement, the long gun is dropped onto the person's hands in the known orientation by gravity.

14. The system defined in claim 3, wherein the top member is a planar component.

15. The storage system in claim 3, wherein the delivery structure is pivoted to the vertical structure.

16. A weapon delivery system for delivering a hidden on gun quickly to a user, comprising:

a vertical structure defining a hidden compartment shaped to store the long gun, and an opening below and adjacent the hidden compartment; and a delivery structure covering the opening when in a closed position, the delivery structure including a top member for supporting the long gun in a known orientation in the hidden compartment, but further, when moved toward an open position, being configured to drop the long gun onto awaiting hands of the user in the known orientation; and two locks, one near each horizontal end of the delivery structure so that either of two people sleeping or resting adjacent the vertical structure can selectively activate the lock to prevent the other of the two people from accessing the long gun.

17. A method for delivering a long gun quickly to a user, comprising:

providing a vertical structure defining a hidden compartment shaped to store the long gun, and an opening below and adjacent the hidden compartment;

providing a delivery structure covering the opening when in a closed position and that includes a top member;

supporting the long gun in a known orientation in the storage location on the top member; and dropping the long gun onto awaiting hands of a user in a known orientation when the top member is moved.

18. A method including providing a bed comprising a mattress and a headboard, the headboard including the vertical structure and the delivery structure defined in claim 17, with the delivery structure being located generally at or above a height of a person sleeping on the mattress, and where the step of dropping the long gun includes the person reaching toward and pressing against the delivery structure to cause the delivery structure to move to the open position to thus drop the long gun, whereby with a simple hand movement, the long gun is dropped onto the person's hands in the known orientation by gravity with the person's hands being in a generally ready position.

19. A weapon delivery system for delivering a hidden long gun quickly to a user, comprising:

a vertical structure including front and rear vertical walls defining a hidden compartment shaped to store the long gun and defining a narrow width configured to hold the long gun in a known orientation where a trigger and handle of the long gun remain in a known stored position, and an opening below and adjacent the hidden compartment; and a delivery structure covering the opening when in a closed position, the delivery structure including a top member supporting the long gun in the known orientation in the hidden compartment, but further loosely slidably supporting the long gun so that, when moved toward an open position, the long gun slides off the top member and drops by gravity onto awaiting hands of the user generally in an orientation similar to the known orientation.

20. The system defined in claim 19, wherein the top member forms a ramp shaped to for slidingly drop the long gun downward and forwardly when in the open position.

* * * * *